US005609379A

United States Patent [19]

Harrelson

[11] Patent Number: 5,609,379

[45] Date of Patent: Mar. 11, 1997

[54] BEVERAGE CUP CARRIER

[75] Inventor: Glen R. Harrelson, Gainsville, Ga.

[73] Assignee: Riverwood International Corporation, Atlanta, Ga.

[21] Appl. No.: 564,762

[22] Filed: Nov. 29, 1995

[51] Int. Cl.[6] ..... B65D 71/00

[52] U.S. Cl. ..... 294/87.2; 206/192; 206/427; 294/160

[58] Field of Search ..... 274/87.1, 87.2, 274/87.26, 87.28, 144, 159, 160, 172; 206/141, 145, 148, 149, 158, 162, 170, 177, 192, 197, 199, 427

[56] References Cited

U.S. PATENT DOCUMENTS

| | | | |
|---|---|---|---|
| 2,397,716 | 4/1946 | Wendler | 294/87.2 |
| 2,650,128 | 8/1953 | Failor | 294/87.2 |
| 3,073,644 | 1/1963 | Baker et al. | 294/87.2 |
| 3,156,358 | 11/1964 | Randrup | 294/87.2 X |
| 3,432,202 | 3/1969 | Ebelhardt | 294/87.2 |
| 3,565,323 | 2/1971 | Katzenmeyer | 294/159 X |
| 3,661,417 | 5/1972 | Inman | 294/87.2 |
| 4,196,807 | 4/1980 | Brom | 294/87.2 X |
| 5,526,925 | 6/1996 | Bernstein | 294/87.2 X |

FOREIGN PATENT DOCUMENTS

| | | | |
|---|---|---|---|
| 2098585 | 3/1972 | France | 294/87.2 |

*Primary Examiner*—Johnny D. Cherry

[57] ABSTRACT

A carrier for beverage cups. A support panel includes openings for receiving beverage cups and a handle panel is foldably connected to the support panel along a centerline. The carrier is of two-ply construction, with the top ply of the support panel including a tab extending into each cup opening for contacting a cup and assisting in maintaining the cup in a more upright position. The carrier is formed from a one-piece blank.

8 Claims, 3 Drawing Sheets

BEVERAGE CUP CARRIER

FIELD OF THE INVENTION

This invention relates to a carrier for beverage cups or similar articles. More particularly, it relates to a carrier of this type which is strong, economical, and capable of being readily opened to its final form.

BACKGROUND OF THE INVENTION

Soft drinks or other beverages are commonly purchased in paper or plastic cup containers at various types of fast food outlets. When more than one beverage cup is purchased by a customer it is often necessary to provide the customer with some means to carry them. This usually takes the form of a tray or a bag, each of which has its limitations. A tray normally requires the use of both hands to hold it, while a bag is usually only large enough to hold two cups. In both cases the danger of the drink cup toppling and spilling is ever present.

It would be desirable to provide customers with a carrier capable of holding a number of cups without danger of the carrier failing or the cups falling out. It would also be highly desirable for the carrier to be inexpensive, readily manufactured and simple to erect and use.

The primary object of the invention is to provide a carrier which meets these objects.

BRIEF SUMMARY OF THE INVENTION

The carrier of the invention is designed to hold beverage cups but may also be used to hold other types of articles which are also circular in cross-section and inwardly tapered from top to bottom. The carrier includes an article support panel, a handle panel foldably connected to the support panel substantially along a centerline of the support panel and at least one opening in the support panel on either side of the handle panel. The support panel openings are smaller in size than the maximum diameter of a cup or other article to be supported so that an article placed in the opening will be supported by the support panel.

Preferably, the handle panel and the support panel are of two-ply construction, with the support panel comprised of a bottom support panel section and two overlapping top support panel sections, both of which are foldably connected to opposite ends of the bottom support panel section. One ply of the handle panel of this preferred arrangement is foldably connected to the overlapping top support panel section, and the portions of the top panel section which overlap the other top panel section extend past opposite ends of the foldable connection of the handle panel.

The carrier may include lines of weakness in both the support panel and the handle panel. By separating the carrier along the lines of weakness, two narrower carriers are formed, each capable of carrying half the number of articles that the original carrier could hold.

In addition, the support panel of the carrier includes a tab which extends inwardly into each support panel opening at a location of the opening most remote from the handle panel. This is for the purpose of assisting the articles to be maintained in a more upright position while the carrier is lifted, as discussed in more detail below.

These and other features and aspects of the invention, as well as other benefits, will readily be ascertained from the detailed description of the preferred embodiment described below.

DETAILED DESCRIPTION OF THE PREFERRED EMBODIMENT

Figure 1:
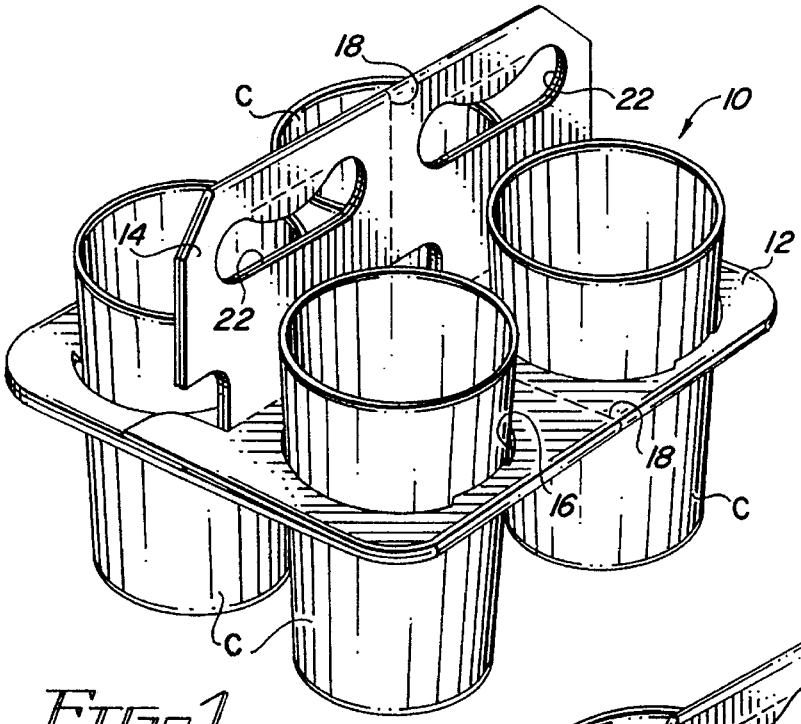
FIG. 1 is a pictorial view of the carrier of the invention, shown holding four beverage cups.
Figure 2:
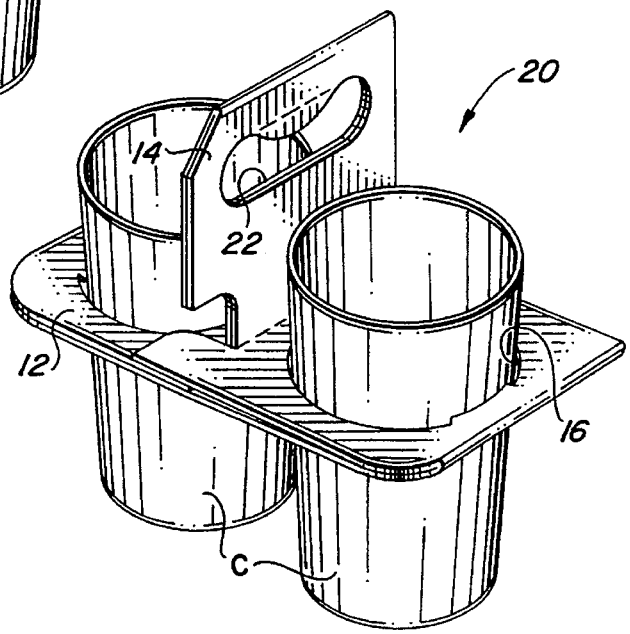
FIG. 2 is a pictorial view of half of the carrier after the carrier has been separated into two parts.

Referring to FIG. 1, the carrier 10 of the invention is comprised of a support panel 12 and a handle panel 14 extending substantially at right angles to the support panel. The support panel 12 includes two substantially circular openings 16 on each side of the handle panel 14 for receiving beverage cups C. A line of weakness 18, which allows the carrier to be readily broken or torn into two halves, extends along the centerline of both the support panel and the handle panel, allowing the carrier to be broken down into two smaller carrier units. A carrier resulting from the separation of the two halves is indicated at 20 in FIG. 2. Each half of the handle panel 14 of the carrier 10 includes a handle opening 22. The handle openings are close enough to each other so that a person holding the carrier can fit one or more fingers through one handle opening and one or more fingers through the other. The openings are large enough so that all the fingers can be inserted through the handle opening of the carrier of FIG. 2.

Figure 3:
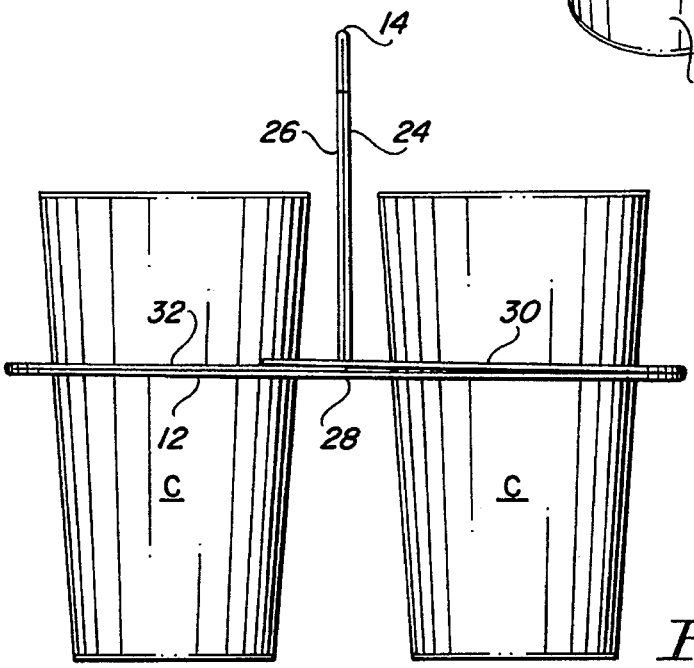
FIG. 3 is an end view of the carrier of FIG. 1.

As shown in FIG. 3, both the handle panel 14 and the support panel 12 are of two-ply construction, the handle panel being comprised of panel sections 24 and 26 and the support panel being comprised of a bottom panel section 28 and top panel sections 30 and 32.

Figure 4:
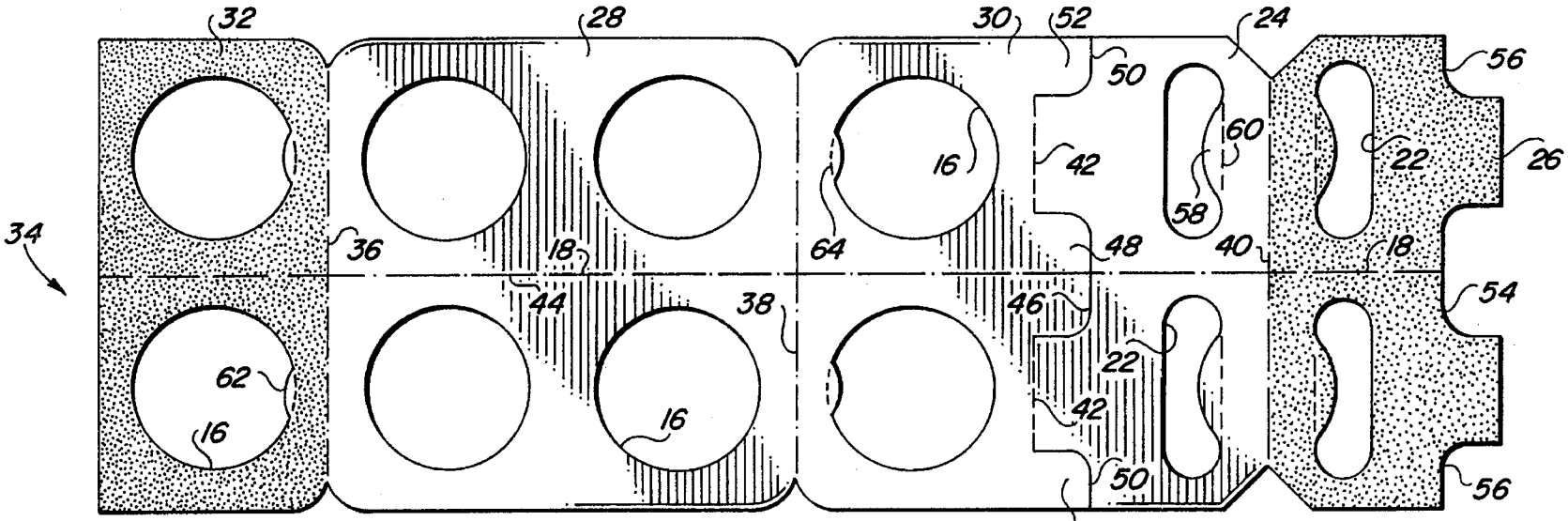
FIG. 4 is a plan view of a blank for forming the carrier of FIG. 1.

The carrier is formed from blank 34 illustrated in FIG. 4. The blank, which preferably is comprised of paperboard but may instead be comprised of any suitable material having adequate strength and flexibility, is of generally rectangular shape. At one end of the blank is the top support panel section 32 and at the other end is the handle panel section 26. Connected to the top support panel section 32 by fold line 36 is the bottom support panel section 28, which in turn is connected to the top support panel section 30 by fold line 38. Connected to the handle panel section 26 by fold line 40 is the handle panel section 24, which in turn is connected by fold line segments 42 to the top support panel section 30. Extending through the longitudinal centerline of the blank is the line of weakness 18, which in practice may be any suitable type such as the illustrated slit interrupted at intervals by short solid segments 44. The segments are of such width as to readily hold the two halves in connected form unless subjected to a separating force capable of being applied by an individual. The fold line 38 preferably extends transversely through the midpoint of the blank at right angles to the line 18.

The inner ends of the fold line segments 42 are connected by a slit 46 which forms a central glue tab 48 at the end of the upper support panel section 30. Slits 50 similarly form glue tabs 52 at the outer end portions of the panel section 30. The free end of the handle panel section 26 is provided with cutouts 54 and 56 of the same size and shape as the glue tabs 48 and 52, respectively.

The handle openings 22 include handle tabs 58 which are connected to the upper edge of the openings by fold lines 60. The beverage cup receiving openings 16 in the bottom support panel section 28 are circular in shape and are sized smaller than the maximum diameter of the cups to be supported. The openings 16 in the top support panel sections 30 and 32 are of the same diameter as the openings in the bottom support panel section but are interrupted by small tabs 62 which are connected to the panel sections 30 and 32 by score lines 64. The tabs 62 are located so as to extend inwardly from a point remote from the handle panel adjacent the outer side edges of the carrier.

Figure 5:
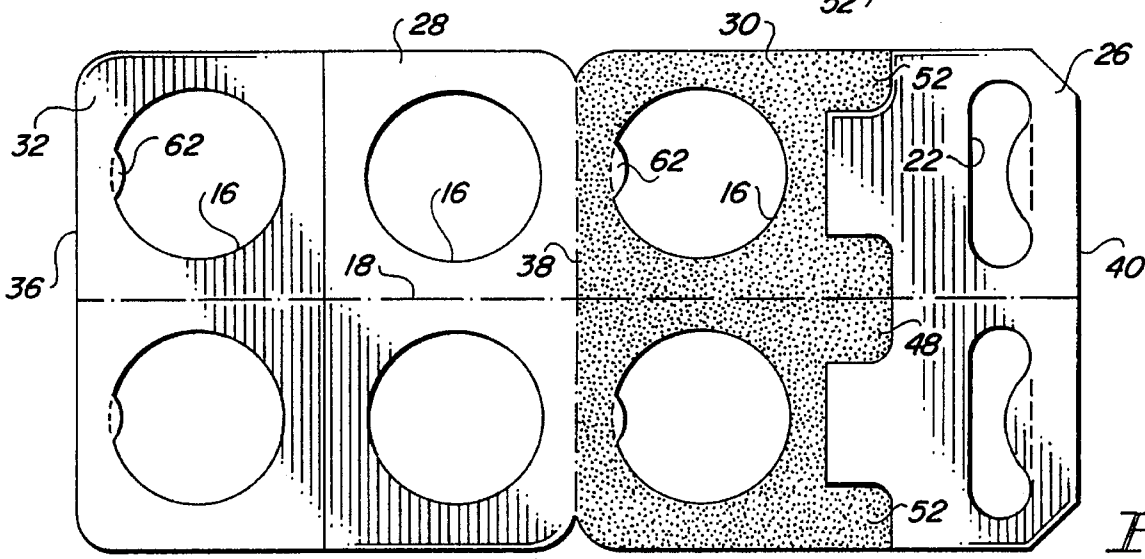
FIG. 5 is a plan view of the blank of FIG. 4 after initial folding steps.
Figure 6:
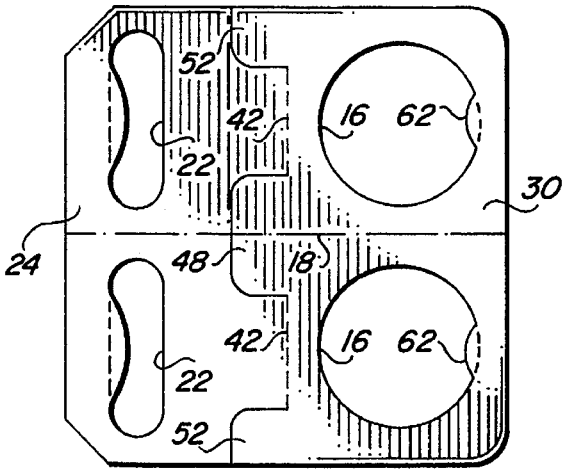
FIG. 6 is a plan view of the blank of FIG. 4 after a final folding step.

To form a carrier from the blank, glue is applied to the top support panel section 32 and the handle panel section 26, as indicated by the stippling in FIG. 4. The panel sections are then folded along the fold lines 36 and 40 and adhered to the adjacent panel sections 28 and 24, respectively, to form the interim configuration shown in FIG. 5. The cutouts 54 and 56 correspond to the glue tabs 48 and 52 so that the end of the panel section 26 substantially meets the fold line segments 42 and the slits 46 and 50. Glue is then applied to the top panel section 30, including the glue tabs 48 and 52, as shown in stipple, and the adhered panel sections 30 and 26 are folded as a unit about the central fold line 38. The panel section 30 is thereby adhered to the bottom support panel section 28, with the glue tabs 48 and 52 being adhered to the upper support panel section 32. The resulting configuration, shown in FIG. 6, is the collapsed form of the carrier, and is the form in which the carrier is supplied to food outlets.

Figure 7:
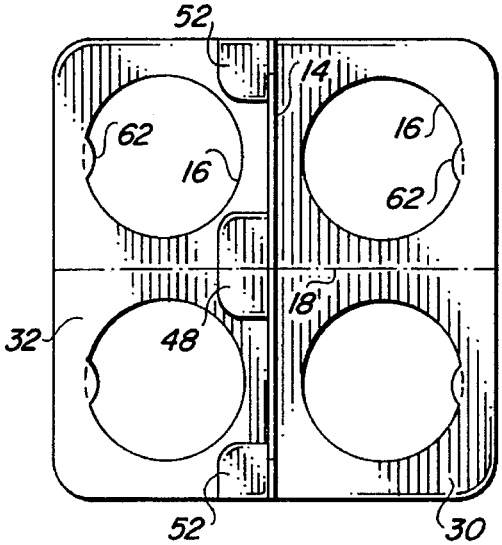
FIG. 7 is a plan view of the carrier after the handle panel has been folded up.

When a purchaser of four beverage servings wishes to have them supplied in a four-cup carrier, the sales person simply has to take a collapsed carrier and fold the handle panel to its upright position. This exposes all the cup-receiving openings 16, as shown in FIG. 7, and places the handle panel in operative position. Beverage cups are then inserted into the openings 16 to produce the loaded carrier illustrated in FIGS. 1 and 3. If only two beverage cups are purchased, the sales person can separate the collapsed carrier along the line of weakness to provide the two-cup carrier illustrated in FIG. 2.

Figure 8:
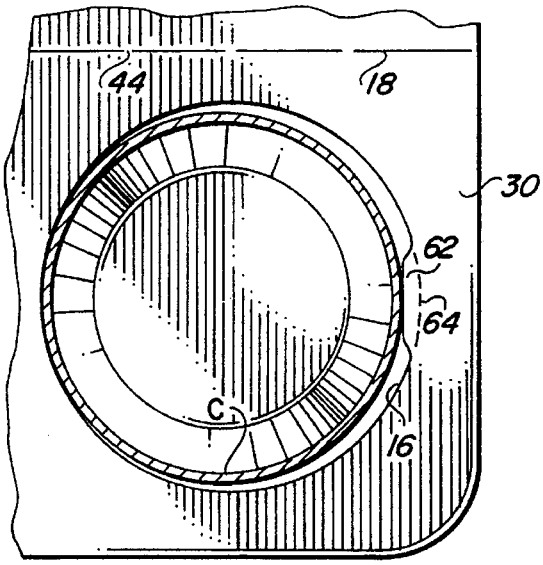
FIG. 8 is an enlarged partial plan view of a cup-receiving opening of the carrier of FIG. 7, showing the relationship of a beverage cup to the opening.
Figure 9:
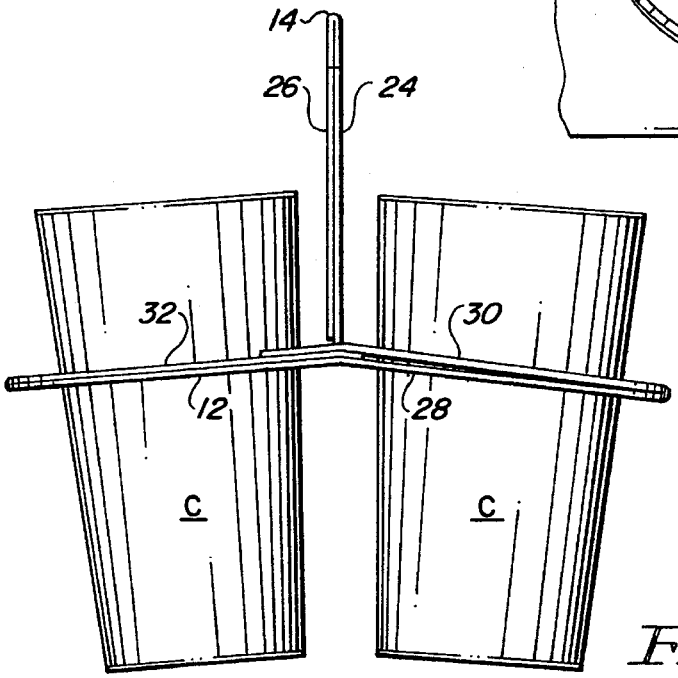
FIG. 9 is an end view of the carrier of FIG. 1 after it has been loaded with filled beverage cups and lifted.

Since beverage cups are normally tapered, the lower end portions are of less diameter than the openings 16, allowing the cups to be readily inserted into the openings. As the cups move relative to the openings, either by inserting the cups into an elevated carrier or by elevating the carrier while the cups are supported on a table or counter surface, at some point during such relative movement the diameter of the cups equals the distance from an associated tab 62 to the opposite point of the opening. This relationship is illustrated in FIG. 8, which shows that the cup is also in contact with a substantial portion of the edge of the opening. When the carrier is lifted by the handle the weight of the filled cups will normally cause the support panel to flex downward on either side of the handle panel as illustrated in FIG. 9. If the cups were held in openings of the same diameter as the diameter of the cups at their point of contact, the cups would be tilted from the horizontal to the same degree that the support panel is angled from the horizontal. The tabs 62 prevent this from occurring and actually exert a force on the tilting cups that tends to kick the bottoms of the cups outwardly. This relationship can be seen in FIG. 9 by observing that the top edge of the cups is closer to the horizontal than the opposite segments of the support panel. The support panel is thereby free to flex as much as necessary under the load of the filled cups without causing the cups to tilt to the point where liquid could be spilled. The score lines 64 which connect the tabs 62 to the upper support panel sections allow the tabs to flex slightly to relieve any excess pressure which may be exerted on one tab more than the others. It is preferred that the tabs extend into the openings in the top support panel section only, so that the resulting single-ply tabs can more readily be flexed. It is not necessary for strength purposes that the tabs be of two-ply construction since a single-ply tab, particularly when slightly flexed, is quite capable of withstanding the pressures to which it is subjected.

Although the invention has been described in connection with a four-cup carrier capable of being broken down into a two-cup carrier, it is possible to provide the blank with an additional section so that the carrier can be used to hold six cups or can be broken down into two- or four-cup carriers. The caliper of the paperboard or other carrier material would of course have to be of such an amount that the carrier is able to support the additional weight and yet is capable of being broken down into smaller carrier units. A carrier can also be used to hold one less cup than a maximum load, since the folded handle connection allows the support panel section holding a full load of beverage cups to flex downwardly a greater amount than the support panel section holding one less cup, while still maintaining the handle panel in a substantially vertical position. The fact that the line of weakness extends through the entire carrier as a result of extending along the entire length of the carrier blank allows the carrier to be readily separated into smaller units.

It will now be appreciated that the carrier of the invention provides a simple, sturdy holder for beverage cups which is not only highly effective but is economical as well. The carrier is strengthened by its two-ply construction, which becomes a three-ply construction at the glue tabs. Although the carrier design of the preferred embodiment has been disclosed in some detail, it will be understood that changes to certain features and aspects of the design which do not affect the overall basic function and concept of the invention may be made by those skilled in the art without departing from the spirit and scope of the invention, as defined by the appended claims.

What is claimed is:

1. A carrier for articles which are circular in cross-section and are inwardly tapered from top to bottom, comprising:

an article support panel comprised of a bottom support panel section and two top support panel sections, the top support panel sections being connected to the bottom support panel section at opposite ends thereof along substantially parallel fold lines, portions of one of the top support panel sections overlapping and being adhered to the other top support panel section;

a two-ply handle panel, one of the plies being foldably connected to the overlapping top support panel section substantially along a centerline of the support panel and the other ply being foldably connected to said one handle panel ply, the portions of the top support panel section which overlap the other top support panel section extending past opposite ends of the foldable connection of said one handle panel ply; and each top support panel section having at least one opening therein and the bottom support panel section having openings aligned with the openings in the top support panel sections, the openings being of a size smaller than the maximum diameter of an article to be supported thereby, whereby articles in the aligned openings are supported by the support panel.

2. A carrier as defined in claim 1, wherein there are two aligned openings in the support panel sections on each side of the handle panel, the carrier including lines of weakness in both the support panel and the handle panel substantially coinciding with a second centerline of the carrier extending at right angles to the first mentioned centerline, the carrier being capable of being readily separated along the lines of weakness, the openings on each side of the handle panel being on opposite sides of the second centerline.

3. A carrier for articles which are circular in cross-section and are inwardly tapered from top to bottom, comprising:

an article support panel comprised of a bottom support panel section and two top support panel sections, the top support panel sections being connected to the bottom support panel section at opposite ends thereof along substantially parallel fold lines, portions of one of the top support panel sections overlapping and being adhered to the other top support panel section;

a handle panel foldably connected to the support panel substantially along a centerline of the support panel, the portions of the top support panel section which overlap the other top support panel section extending past opposite ends of the foldable connection of the handle panel;

each top support panel section having at least one opening therein and the bottom support panel section having openings aligned with the openings in the top support panel sections, the openings being of a size smaller than the maximum diameter of an article to be supported thereby, whereby articles in the aligned openings are supported by the support panel; and each top support panel section including a tab extending inwardly into each opening therein at a location of the opening most remote from the handle panel, each opening having a circular edge terminating at opposite ends of an associated tab.

4. A carrier as defined in claim 3, wherein each tab is connected to the top support panel section along a score line.

5. A blank for forming a carrier for articles which are circular in cross-section and are inwardly tapered from top to bottom, comprising:

a bottom support panel section having a plurality of openings therein, the openings being of a size smaller than the maximum diameter of an article to be supported thereby;

a first top support panel section connected by a fold line to an end of the bottom support panel section, the first top support panel section including an opening of substantially similar size to the openings in the bottom support panel section;

a second top support panel section connected by a fold line to an opposite end of the bottom support panel section, the second top support panel section including an opening of substantially similar size to the openings in the bottom support panel section;

a handle panel section connected to the second top support panel section along a fold line substantially parallel to the fold line connecting the second top support panel section to the bottom support panel section;

the second top support panel section including a glue tab at each end of the fold line connecting the handle panel section to the second top panel support section;

the glue tabs being separated from the handle panel section by slits and overlapping the first top support panel section in a carrier formed from the blank, the openings in the first and second top support panel sections overlying associated openings in such a carrier; and a second handle panel section connected to the first mentioned handle panel section by a fold line substantially parallel to the fold line connecting the first mentioned handle panel section to the second top support panel section.

6. A blank as defined in claim 5, wherein the blank is comprised of two substantially identical halves separated from each other by a line of weakness extending along a centerline of the blank at right angles to the fold lines, whereby a carrier formed from the blank is capable of being readily separated along the line of weakness.

7. A blank for forming a carrier for articles which are circular in cross-section and are inwardly tapered from top to bottom, comprising:

a bottom support panel section having a plurality of openings therein, the openings being of a size smaller than the maximum diameter of an article to be supported thereby;

a first top support panel section connected by a fold line to an end of the bottom support panel section, the first top support panel section including an opening of substantially similar size to the openings in the bottom support panel section;

a second top support panel section connected by fold line to an opposite end of the bottom support panel section, the second top support panel section including an opening of substantially similar size to the openings in the bottom support panel section;

a handle panel section connected to the second top support panel section along a fold line substantially parallel to the fold line connecting the second top support panel section to the bottom support panel section;

the second top support panel section including a glue tab at each end of the fold line connecting the handle panel section to the second top panel support section;

the glue tabs being separated from the handle panel section by slits and overlapping the first top support panel section in a carrier formed from the blank, the openings in the first and second top support panel sections overlying associated openings in such a carrier;

each top support panel section including a tab extending inwardly into each top support panel opening at a location of the opening nearest the fold line connecting the top support panel section to the bottom support panel section, whereby the tabs are remote from a handle panel formed from the handle panel section in a carrier formed from the blank; and each opening in the top support panel sections having a circular edge terminating at opposite ends of an associated tab.

8. A blank as defined in claim 7, wherein each tab is connected to an associated top support panel section along a score line.

* * * * *